US006865454B2

(12) United States Patent
Kane et al.

(10) Patent No.: US 6,865,454 B2
(45) Date of Patent: Mar. 8, 2005

(54) TRAIN CONTROL SYSTEM AND METHOD OF CONTROLLING A TRAIN OR TRAINS

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering Inc., Orange Park, FL (US)

( * ) Notice: Subject to any disclaimer, the term of this patent is extended or adjusted under 35 U.S.C. 154(b) by 0 days.

(21) Appl. No.: 10/186,426

(22) Filed: Jul. 2, 2002

(65) Prior Publication Data

US 2004/0006413 A1 Jan. 8, 2004

(51) Int. Cl.[7] ..... B61L 29/00
(52) U.S. Cl. ..... 701/19; 701/301; 246/122 R
(58) Field of Search ..... 701/19–23, 200–216, 701/300, 301; 246/72, 122 R, 167 R, 125, 176, 177, 126, 182 R, 186; 702/158, 159; 340/902, 903, 904

(56) References Cited

U.S. PATENT DOCUMENTS

| | | | |
|---|---|---|---|
| 4,181,943 | A | 1/1980 | Mercer, Sr. et al. |
| 4,459,668 | A | 7/1984 | Inoue et al. |
| 4,561,057 | A | 12/1985 | Haley, Jr. et al. |
| 4,711,418 | A | 12/1987 | Aver, Jr. et al. |
| 5,072,900 | A | 12/1991 | Malon |
| 5,129,605 | A | 7/1992 | Burns et al. |
| 5,177,685 | A | 1/1993 | Davis et al. |
| 5,332,180 | A | 7/1994 | Peterson et al. |
| 5,340,062 | A | 8/1994 | Heggestad |
| 5,364,047 | A | 11/1994 | Petit et al. |
| 5,394,333 | A | 2/1995 | Kao |
| 5,398,894 | A | 3/1995 | Pascoe |

(List continued on next page.)

OTHER PUBLICATIONS

"Testimony of Jolene M. Molitoris, Federal Railroad Administrator, U.S. Department of Transportation before the House Committee on Transportation and Infrastructure Subcommittee on Railroads", Federal Railroad Adminstration, United States Department of Transportation, Apr. 1, 1998.

"System Architecture, ACTS Specification 100", May 1995.

"A New World for Communications & Signaling", Progressive Railroading, May 1986.

"Advanced Train Control Gain Momentum", Progressive Railroading, Mar. 1986.

"Railroads Take High Tech in Stride", Progressive Railroading, May 1985.

Lyle, Denise, "Positive Train COntrol on CSXT", Railway Fuel and Operating Officers Association, Annual Proceedings, 2000.

Lindsey, Ron A., "C B T M, Communications Based Train Management", Railway Fuel and Operating Officers Association, Annual Proceedings, 1999.

Moody, Howard G, "Advanced Train Control Systems A System to Manage Railroad Operations", Railway Fuel and Operating Officers Associations, Annual Proceedings, 1993.

(List continued on next page.)

*Primary Examiner*—Richard M. Camby
(74) *Attorney, Agent, or Firm*—Piper Rudnick LLP; Steven B. Kelber

(57) ABSTRACT

A train control system includes positioning systems at the end of the train and at the front of the train, allowing the conductor or engineer to unambiguously determine that no cars of the train have become detached. The positioning system at the end of the train is also used to verify that the entire train has cleared a block. This information can be relayed to a dispatcher, thereby eliminating the need for trackside sensing equipment. A control unit prevents the train from moving without an authorization that includes the train's current position.

4 Claims, 2 Drawing Sheets

U.S. PATENT DOCUMENTS

| | | | |
|---|---|---|---|
| 5,452,870 | A | 9/1995 | Heggestad |
| 5,533,695 | A | 7/1996 | Heggestad et al. |
| 5,620,155 | A | 4/1997 | Michalek |
| 5,699,986 | A | 12/1997 | Welk |
| 5,740,547 | A | 4/1998 | Kull et al. |
| 5,751,569 | A | 5/1998 | Metel et al. |
| 5,803,411 | A | 9/1998 | Ackerman et al. |
| 5,828,979 | A | 10/1998 | Polivka et al. |
| 5,867,122 | A | 2/1999 | Zahm et al. |
| 5,944,768 | A | 8/1999 | Ito et al. |
| 5,950,966 | A | 9/1999 | Hungate et al. |
| 5,978,718 | A | 11/1999 | Kull |
| 5,995,881 | A | 11/1999 | Kull |
| 6,049,745 | A | 4/2000 | Douglas et al. |
| 6,081,769 | A | 6/2000 | Curtis |
| 6,102,340 | A | 8/2000 | Peek et al. |
| 6,112,142 | A | 8/2000 | Shockley et al. |
| 6,135,396 | A | 10/2000 | Whitfield et al. |
| 6,179,252 | B1 | 1/2001 | Roop et al. |
| 6,218,961 | B1 | 4/2001 | Gross et al. |
| 6,311,109 | B1 | 10/2001 | Hawthorne et al. |
| 6,322,025 | B1 | 11/2001 | Colbert et al. |
| 6,345,233 | B1 | 2/2002 | Erick |
| 6,371,416 | B1 | 4/2002 | Hawthorne |
| 6,373,403 | B1 | 4/2002 | Korver et al. |
| 6,374,184 | B1 | 4/2002 | Zahm et al. |
| 6,377,877 | B1 | 4/2002 | Doner |
| 6,397,147 | B1 | 5/2002 | Whithead |
| 6,421,587 | B2 | 7/2002 | Diana et al. |
| 6,456,937 | B1 | 9/2002 | Doner et al. |
| 6,459,964 | B1 | 10/2002 | Vu et al. |
| 6,459,965 | B1 | 10/2002 | Polivka et al. |
| 6,487,478 | B1 | 11/2002 | Azzaro et al. |
| 2001/0056544 | A1 | 12/2001 | Walker |
| 2002/0070879 | A1 | 6/2002 | Gazit et al. |

OTHER PUBLICATIONS

Ruegg, G.A., "Advanced Train Control Systems ATCS", Railway Fuel and Operating Officers Association Annual Proceedings, 1986.

Malone, Frank, "The Gaps Start to Close"Progressive Railroading, May 1987.

"On the Threshold of ATCS", Progressive Railroading, Dec. 1987.

"CP Advances in Train Control", Progressive Railroading, Sep. 1987.

"Communications/Signaling: Vital for dramatic railroad advances", Progressive Railroading, May 1988.

"ATCS's System Engineer", Progressive Railroading, Jul. 1988.

"The Electronic Railroad Emerges", Progressive Railroading, May 1989.

"$C^3$ Comes to the Railroads", Progressive Railroading, Sep. 1989.

"ATCS on Verge of Implementation", Progressive Railroading, Dec. 1989.

"ATCS Evolving on Railroads", Progressive Railroading, Dec. 1992.

"High Tech Advances Keep Railroads Rolling", Progressive Railroading, May 1994.

"FRA Promotes Technology to Avoid Train–to–Train Collisions", Progressive Railroading, Aug. 1994.

"ATCS Moving slowly but Steadily from Lab for Field", Progressive Railroading, Dec. 1994.

Judge, T., "Electronic Advances Keeping Railroads Rolling", Progressive Railroading, Jun. 1995.

"Electronic Advances IMprove Railroads Manage", Progressive Railroading, Dec. 1995.

Judge, T., "BNSF/UP PTS Pilot Advances in Northwest", Progressive Railroading, May 1996.

Foran, P., "Train Control Quandary, Is CBTC viable? Railroads, Suppliers, Hope Pilot Projects Provide Clues", Progressive Railroading, Jun. 1997.

"PTS Would've Prevented Silver Spring Crash: NTSB", Progressive Railroading, Jul. 1997.

Foran, P., "A 'Positive' Answer to the Interoperability Call", Progressive Railroading, Sep. 1997.

Foran, P., "How Safe is Safe Enough?", Progressive Railroading, Oct. 1997.

Foran, P., "A Controlling Interest In Interoperability", Progressive Railroading, Apr. 1998.

Derocher, Robert J., "Transit Projects Setting Pace for Train Control",Progressive Railroading, Jun. 1998.

Kube, K., "Variations on a Theme", Progressive Railroading, Dec. 2001.

Kube, K., "Innovation in Inches", Progressive Railroading, Feb. 2002.

Vantuono, W., "New York Leads a Revolution", Railway Age, Sep. 1996.

Vantuono, W., "Do you know where your train is?", Railway Age, Feb. 1996.

Gallamore, R., "The Curtain Rises on the Next Generation", Railway Age, Jul. 1998

Burke, J., "How R&D is Shaping the 21st Century Railroad", Railway Age, Aug. 1998.

Vantuono, W., "CBTC: A Maturing Technology", Third International Conference On Communications Based Train Control, Railway Age, Jun. 1999.

Sullivan, T., "PTC—Is FRA Pushing Too Hard?", Railway Age, Aug. 1999.

Sullivan, T., "PTC: A Maturing Technology", Railway Age, Apr. 2000.

Moore, W., "How CBTC Can Increase Capacity", Railway Age, Apr., 2001.

Vantuono, W., "CBTC: The Jury is Still Out", Railway Age, Jun. 2001.

Vantuono, W., "New–tech Train Control Takes Off", Railway Age, May 2002.

Union Switch & Signal Intermittent Cab Signal, BUlletin 53, 1998.

GE Harris Product Sheet: "Advanced Systems for Optimizing Rail Performance" and "Advanced Products for Optimizing train Performance", undated.

GE Harris Product Sheet: "Advanced, Satellite–Based Warning Systems Enhances Operating Safety", undated.

Furman, E., et al., "Keeping Track of RF", GPS World, Feb. 2001.

Department of Transportation Federal Railroad Administration, Federal Register, vol. 66, No. 155, pp. 42352–42396, Aug. 10, 2001.

TRAIN CONTROL SYSTEM AND METHOD OF CONTROLLING A TRAIN OR TRAINS

BACKGROUND OF THE INVENTION

1. Field of the Invention

The invention relates to railroads generally, and more particularly to automatic control of trains.

2. Discussion of the Background

Controlling the movement of trains in a modem environment both in a train yard and on the main line is a complex process. Collisions with other trains must be avoided and regulations in areas such as grade crossings must be complied with. The pressure to increase the performance of rail systems, in terms of speed, reliability and safety, has led to many proposals to automate various aspects of train operation.

One traditional method for controlling trains is known as track warrant control. This method is most often used in areas of dark territory (track that does not include a wayside signaling system). Simply put, a track warrant is permission to occupy a given section of track, i.e., a block. The traditional track warrant control method, which is defined in the General Code of Operational Rules, involves "written" verbal orders which may be modified or rescinded by communication over a radio with a dispatcher. In the system, a dispatcher gives a train or a maintenance crew verbal authority (a warrant) to occupy a portion of main line track between named locations (e.g., mile markers, switches, stations, or other points). In addition to specifying certain track sections, track warrants can specify speed limits, direction, time limits, and whether to clear the main line (e.g., by entering a secondary track such as a siding) and/or any other section of track (sidings, yards secondary track, etc . . . ). There is a complicated and time consuming procedure by which track warrants are issued which involves the train conductor or engineer reading back the warrant to the dispatcher before the warrant goes into effect. One important disadvantage to this system is that it relies on human beings, both to communicate the warrant properly and to ensure that the warrant is complied with. The system is thus subject to errors which can be disastrous.

Some systems, such as the Track Warrant Control System sold by RDC (Railroad Development Corporation), have automated some of the track warrant control method, such as by sending the warrant to the train via a computer system. Another system, Automatic Block Signaling (ABS), provides for automated wayside signaling of block status and authority to enter or occupy a block. In this system, track warrants may overlap and the conductor or engineer uses the automatic wayside signals to determine when and how to proceed in a given block. Again, human beings are involved and errors are possible.

In another system known as Cab Signal, a display is provided in the cab for the engineer/conductor. This display basically displays wayside signals to the engineer/conductor and forces the engineer/conductor to acknowledge signals that are more restrictive than the current signal. However, the Cab Signal system does not force the engineer/conductor to obey the more restrictive signal. Thus, an engineer/conductor may be forced to acknowledge a signal that reduces the maximum speed from 20 m.p.h. to 10 m.p.h., but the train will not be forced to slow to 10 m.p.h.; rather, the engineer/conductor must take action to slow the train. Once again, the potential for error exists.

A second traditional system known as Centralized Traffic Control (CTC) allows a dispatcher to control movement of trains by controlling track switches and wayside signals from a central dispatch office. In these systems, there is no direct communication with the locomotive cab; rather, the dispatcher sends commands to switches and wayside signals and receives feedback from them. Again, the wayside signal indicate authority to occupy a block or to proceed to the next block. These systems still require a human operation to control movement of the train in accordance with wayside signals. Updated CTC systems such as the Radio Actuated Code System from Harmon Electronics integrate differential GPS (global positioning system) technology and other technology into these systems, but they are still subject to human error.

Some efforts at automation have been made. For example, a rudimentary system known as Automatic Train Stop (ATS), sold by Union Switch and Signal Inc., functions by means of a mechanical contact between a wayside trip arm and a brake emergency trip switch or cock mounted to the car. If the wayside signal is in a stop condition and the train passes the signal, the wayside trip arm activates the emergency brake switch, thereby initiating an emergency brake operation. One problem with a rudimentary system such as this is that the braking operation is not started until the train passes the wayside switch, which means the train will not stop until some point after the switch. Thus, the system will not prevent a collision with an object that is close to the wayside signal.

Another problem with all of the foregoing system is that they require wayside signaling. These wayside signal systems are expensive to maintain and operate. Doing away with wayside signaling has been desired by train operators for many years.

The foregoing concerns have led to more automated systems. For example, in the Automatic Train Control (ATC) system, train location information, speed information, and train control information are continually exchanged between a train cab and computerized wayside controllers in real time (in some systems, track rails are used to carry this information). In this system, it is not necessary for a conductor or engineer to look for wayside signals. If a wayside signal is missed by a conductor or engineer, or conditions change after the wayside signal is passed, the information is available to the conductor or engineer in the cab. Some ATC systems automatically apply the brakes if a stop signal is passed. As discussed above in connection with the ABS system, such after-the-fact braking systems may not prevent collision with an object located in close proximity to a wayside signal. Other systems, such as the Advanced Train Control System proposed by Rockwell International, will automatically apply the brakes if a track warrant is about to be exceeded.

An advanced version of the ATC system, referred to as the Advanced Automated Train Control (AATC) system, is offered in combination with an Automatic Train Operation (ATO) system by General Electric Transportation Systems to fully automate movement of trains.

In at least one New Jersey Transit system, the ATC system has been combined with a Positive Train Stop (PTS) system. The PTS system uses transponders along the tracks and on-board receivers to supplement the ATC system. PTS is an intelligent system that anticipates signaling and will stop or slow the train automatically without operator input. For example, as discussed above, while ATC will stop the train automatically if the train runs through a stop signal, PTS will stop the train before actually going through a stop signal. In addition, the PTS system allows for "civil-speed" and "temporary construction" speed restrictions. The term Advanced Speed Enforcement System (ASES) is used when ATC and PTS are combined.

Another system sold by Harmon Industries and referred to as Ultracab also involves an ATC system that will automatically stop a train before going through a stop signal. However, one drawback to both the PTS and Ultracab systems is that they assume the worst case scenario when automatically stopping a train, i.e, they employ a fixed braking curve. Thus, for example, when these system detect an upcoming stop signal, they will apply the brakes at a distance that assumes that the train is traveling downhill on the most steeply graded section of track, and that the train is at the maximum weight. This worst-case assumption/fixed braking curve makes such systems inefficient.

In more recent years a next generation train control system referred to as Positive Train Control, or PTC, has been proposed. A number of companies have proposed different systems that function in different ways to implement PTC systems. For example, GE Transportation Systems markets a product referred to as the Incremental Train Control System (ITCS) and GE Harris Railway Electronics markets a version referred to as Precision Train Control. The Federal Railroad Administration (FRA) has stated that from the point of view of safety objectives, a PTC system needs to achieve the following core functions with a high degree of reliability and effectiveness: prevent train-to-train collisions (positive train separation); enforce speed restrictions, including civil engineering restrictions and temporary slow orders; and provide protection of roadway workers and their equipment operating under specific authorities.

In addition to the performance and safety issues discussed above, vandalism is becoming an increasing concern of train operators. One form of vandalism is the unauthorized moving of trains. Much like some people 'borrow' a car for joyriding, some will joyride on trains. Unlike cars, a key is often not required to "start" a train. While a locomotive cab may be locked, it is fairly easy to break the lock and enter the cab, at which point a train can be made to move. Unauthorized movement of a train, whether on a main line, in a train yard, or on some other section of track, can cause much damage even if a stop signal is not violated.

Another vandalism problem is the uncoupling of trains while the trains are at rest. Ordinarily, but not necessarily, if a car becomes detached from a train due to some mechanical failure, the loss in pressure in the brake lines will cause the trains to immediately stop. However, if a vandal disconnects a car from a train while in the yard and properly shuts the air valve for the brake line to the remaining cars, this protection does not work. When a train has many cars, a conductor or engineer may not notice that the car has been disconnected. In this case, the car left behind may cause a collision with an oncoming train or may just roll away and then cause a collision. This problem is partially solved by the use of known end-of-train devices that include motion sensors that allow a conductor or engineer in the locomotive cab to verify that the last car is in motion. However, the motion sensors sometimes break or give false readings and, under certain circumstances described more fully herein, may mislead a conductor or engineer even when working properly.

What is needed is a method and system that allows for the efficient and safe operation of a railroad while mitigating the effects of vandalism.

SUMMARY OF THE INVENTION

The present invention meets the aforementioned need to a great extent by providing a computerized train control system in which a dispatcher sends track warrants directly to a locomotive cab, and which will not allow the train to move at all, whether the train is on the main line or in a train yard, until an appropriate authority is received and that will automatically stop in the event of a computer failure or the train before the train can exceed a track warrant limit.

In one aspect of the invention, the system includes an end of train telemetry unit by which the cab can monitor movement of the last car in the train to ensure that no cars have been improperly separated from the train.

In another aspect of the invention, the system can operate in a semiautomatic mode in which a conductor or engineer is able to control movement of the train as long as no track warrant limits or stop signals are violated, and in a fully automatic mode in which the system controls movement of the train.

In yet another aspect of the system, a control module calculates a required stopping distance based on many factors, including but not limited to the length of the train, the number and type of loads and empties, the speed of the train, weight of the train, number of locomotives and the curvature and grade of the track on which the train will be operating as it approaches a track warrant limit.

In another aspect of the invention, graduated as well as full braking 'penalties' can be imposed when an engineer or conductor fails to apply the brakes in a manner sufficient to comply with speed restrictions (permanent and/or temporary) and/or warrants/authorities. A full braking penalty applies sufficient brake pressure to cause the train to come to a complete stop. A graduated penalty increases the brake pressure until the train is in compliance with the signal or speed condition, or has slowed enough such that the distance between the train and a stop signal has become greater than the maximum amount of time required to stop the train under the currently applicable conditions.

In still another aspect of the invention, a positioning system is used to provide train location information, and map data is used to determine the location of other objects of interest such as stop signals, block boundaries, and restricted speed areas.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION OF PREFERRED EMBODIMENTS

The present invention will be discussed with reference to preferred embodiments of train control systems. Specific details, such as specific algorithms and hardware, are set forth in order to provide a thorough understanding of the present invention. The preferred embodiments discussed herein should not be understood to limit the invention.

Figure 1:
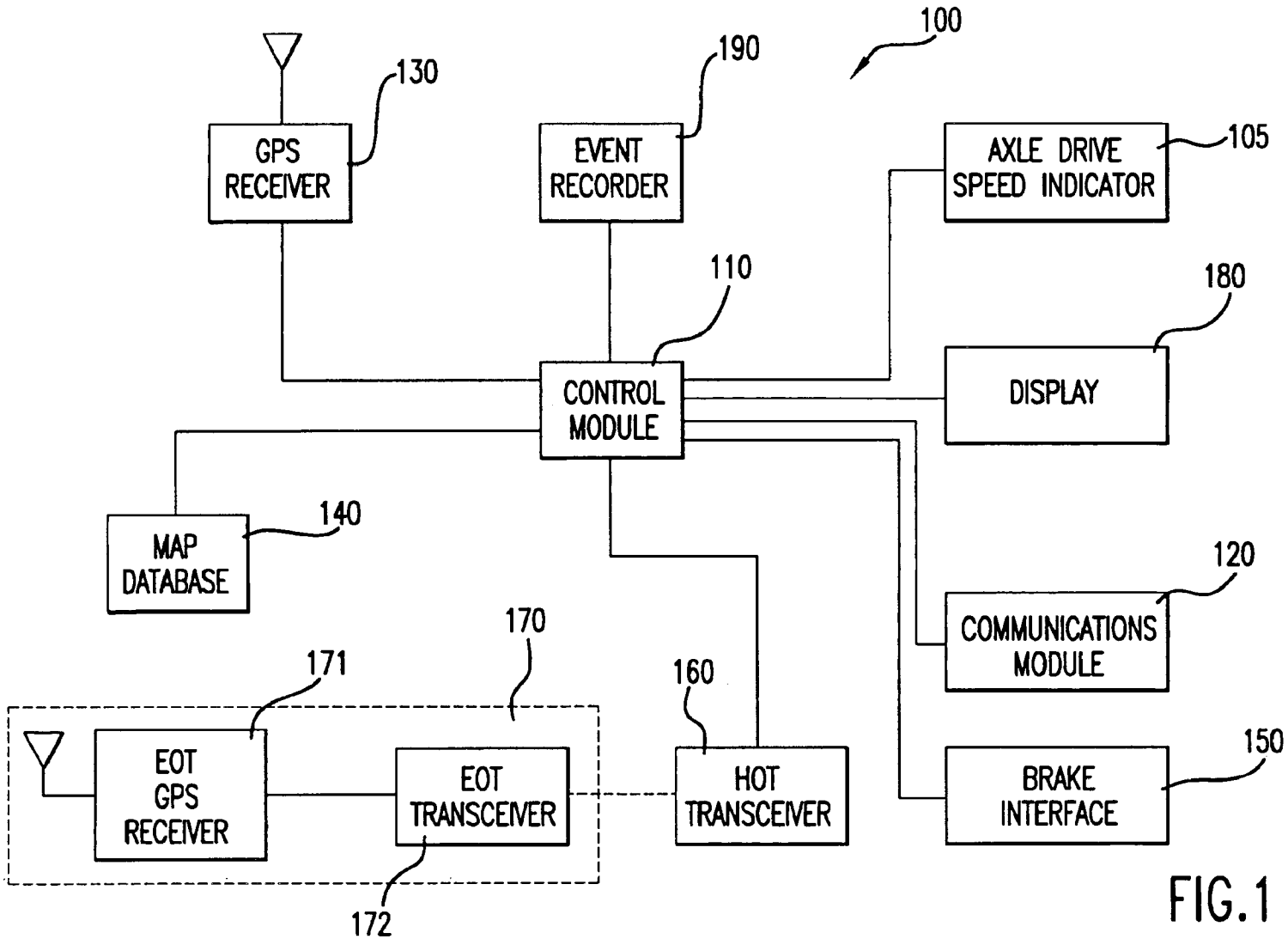
FIG. 1 is a logical block diagram of a train control system according to one embodiment of the invention.

Referring now to the drawings, wherein like reference numerals designate identical or corresponding parts throughout the several views, FIG. 1 is a logical block diagram of a train control system 100 according to the present invention. The system 100 includes a control module 110, which typically, but not necessarily, includes a microprocessor. The control module 110 is the center of the train control system and is responsible for controlling the other components of the system. Connected to the control module is a communications module 120. The communications module is responsible for conducting all communications between the system 100 and the central dispatcher computer system (not shown in FIG. 1). These communications may occur in a variety of ways, such as over the air or through the rails of the train track. In some embodiments, wayside signals transmit information to the system 100. All equipment necessary for such communications (e.g., antennas) are connected to the communications module 120.

Also connected to the control module 110 is a positioning system such as a GPS receiver 130. The GPS receiver 130 can be of any type, including a differential GPS, or DGPS, receiver. Other types of positioning systems, such as inertial navigation systems (INSs) and Loran systems, can also be used. Such positioning systems are well known in the art and will not be discussed in further detail herein. [As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that are used to transmit information to the GPS receiver.]

The GPS receiver 130 continuously supplies the control module 110 with position information concerning the train to which the control system 100 is attached. This information allows the control module 110 to determine where it is at any point in time. The GPS receiver is preferably sufficiently accurate to unambiguously determine which of two adjacent tracks a train is on. By using train position information obtained from the GPS receiver 130 as an index into the map database 140, the control module can determine its position relative to other points of interest on the railroad such as switches, sidings, stations, etc. As discussed in further detail below, this allows the control module 10 to warn the conductor or engineer if an authority (speed, position, etc.) is about to be exceeded and, if required, to automatically stop or slow down the train before the authority is exceeded.

In addition to the GPS receiver 130, an axle drive speed indicator 105 is also connected to the control module 110. The axle drive speed indicator 105 is a tachometer which measures the axle rotation, from which the speed of the train can be derived if the wheel size is known. End-of-axle magnetic pick-ups are used in some embodiments. It is also possible to use a signal that measures the rotation speed of the motor driving the axle to perform this function. In the event that the GPS system becomes unavailable, the system can operate by estimating distance traveled from the rotation of the axle or motor. However, wheel slippage and changes in wheel size over time can effect the accuracy of such a system. The system 100 may be configured to compensate for wheel wear in the manner described in co-pending U.S. patent application Ser. No. 10/157,874, filed May 31, 2002, entitled "Method and System for Compensating for Wheel Wear on a Train," the contents of which are hereby incorporated by reference herein.

A map database 140 is connected to the control module 110. The map database 140 preferably comprises a non-volatile memory such as a hard disk, flash memory, CD-ROM or other storage device, on which map data is stored. Other types of memory, including volatile memory, may also be used. The map data preferably includes positions of all wayside signals, switches, grade crossings, stations and anything else of which a conductor or engineer is required to or should be cognizant. The map data preferably also includes information concerning the direction and grade of the track. Use of the information in the map database 140 will be discussed below.

A brake interface 150 is also connected to the control module 110. The brake interface monitors the brake and allows the control module 110 to activate and control the brakes when necessary. The brake interface 150 preferably includes an input board that inputs analog signals from pressure transducers connected to monitor the main reservoir pressure, brake pipe pressure and brake cylinder pressure. The input board includes analog-to-digital converters to convert the analog signals from the transducers to digital signals. To ensure that the brake interface 150 is functioning properly, the control module 110 will feed a signal of a known constant voltage to the input board, where it will be converted into a digital signal and read back by the control module 110. If a failure in the brake interface 150 is detected, the dispatcher and the conductor/engineer will be notified and the brakes will automatically be applied and the control module 110 will not allow the train to be moved.

A head of train (HOT) transceiver 160 is also connected to the control module 110. The HOT transceiver 160 is in communication with a rear of train unit 170 that includes an end of train (EOT) GPS receiver 171 and an EOT transceiver 172 that is preferably located at the rear of the last car on the train. (As discussed above in connection with the GPS receiver 130, other types of positioning systems could be used in place of the EOT GPS receiver 171). The communication between the EOT transceiver 172 and the HOT transceiver 160 may be wireless methods, power line carrier methods, or by any other method. In operation, communications between the EOT GPS receiver 171 and the control module 110 are constantly monitored. If a message from the EOT GPS receiver 171 has not been received for some predetermined period of time, or if the data in the message has been corrupted (e.g., the speed in the message is faster than the train can travel), or does not agree with the information from the GPS receiver 130 in the locomotive at the front of the train, the control module 110 can either display an operator alert or, in some embodiments, stop the train and notify the dispatcher.

The EOT GPS receiver 170 allows the system 100 to detect when one or more cars has been disconnected from the train. As discussed above, vandalism in the form of someone purposely disconnecting one or more cars while trains are at rest is an important safety concern. If a vandal closes off the brake line valve, the disconnection may not be detected because, when trains are long, the end of the train may not be visible from the locomotive. In the past, yard personnel, conductors and/or engineers traveling on an adjacent track in the opposite direction have been relied on to read off the number on the last car in order to verify that no cars have been disconnected. However, such a system is not perfect for at least the reason that yard personnel or personnel on another train are not always available to perform this function.

End of train devices that employ a motion sensor are known. However, these devices do not fully ensure that the last car has not been disconnected. The motion sensor does not indicate speed; it simply indicates whether or not there is motion above some threshold. It is possible that a broken motion sensor will give an indication of motion when in fact there is no motion. In such a situation, the conductor or engineer has no way of knowing that the car has been disconnected.

Furthermore, even when the motion sensor is working properly, it is possible that a disconnection may not be detected. In one incident known to the inventors, a distributed power train (a train in which one or more locomotives is placed at the front of the train, followed by one or more cars, followed by one or more additional locomotives and cars) was temporarily stopped at a crossing. While stopped, a vandal disconnected the second group of locomotives from the preceding car, and closed off the brake valves. In this train, the second group of cars connected to the second group of locomotives was heavier than the first group of cars connected to the first group of locomotives. When the conductor or engineer in the lead locomotive in the first group began moving the train by setting the throttle to a desired position, the throttles in all the other locomotives in both groups was set by radio control to the same position. Because the second group of cars was heavier than the first, there was a difference in speed between the two portions of the train and the first portion of the train began to separate from the second portion. The EOT motion sensor transmitted the correct status that the EOT (last car) was moving although it did not indicate the train was separated. In this incident, the separation grew to over a mile before the engineer noticed that there was a problem. The danger in such a situation is obvious.

In the foregoing case, an end of train device with a motion sensor would not have alerted the conductor or engineer to the problem because the second portion of the train was moving, albeit at a slightly slower pace. However, with a GPS receiver, the separation between the portions of the trains would have been readily apparent. Furthermore, unlike a motion sensor, if a GPS receiver fails, it is readily apparent as either there is no data, or the data doesn't change, or the data is obviously wrong.

When the train is moving, the control unit 110 periodically checks the two positions reported by the GPS receiver 130, 171, calculates the actual distance between them, and compares this actual distance to an expected distance. If the actual distance exceeds the expected distance, the control unit 110 takes corrective action.

In some embodiments, the distance between the EOT GPS receiver 171 and the GPS receiver 130 at the front of the train is calculated as a straight-line distance. This straight-line distance will necessarily decrease when the train is traveling along a curved section of track. Some embodiments simply ignore this decrease and compare the difference in positions reported by the two receivers to a static expected distance between the receivers based on the assumption that the train is on a straight section of track, taking corrective action only when the actual distance exceeds this static expected difference. In some embodiments, this static distance is based on the consist information (which may include the length of the train, or the number of cars and their length or their type—from which length can be determined—or other data that allows the length of the train to be calculated) reported to the train by the dispatcher. This method allows the monitoring function to be performed if the map database 140 is not provided in the system 100 or is not functioning. Other embodiments utilize the map database 140 to determine the amount of curvature on the track section between the GPS receiver 130 and the EOT GPS receiver 171 and correspondingly decrease the expected distance between the two GPS receivers as a function of this curvature. In this fashion, if the last car becomes detached from the first car on a curved section of track, the situation can be more quickly recognized.

Using a positioning system such as an EOT GPS receiver 171 in the end of train device also eliminates the need to use train detection circuits at track locations near wayside signals. In many existing railroads, circuits detect when a train has passed a wayside signal and notify the dispatcher and/or other trains of this event. If an end of train positioning system is used, the fact that the end of train has passed the wayside signal can be transmitted from the cab to the dispatcher, thereby eliminating the need for a sensing circuit on the tracks to verify that the end of train has passed the signal.

Figure 2:
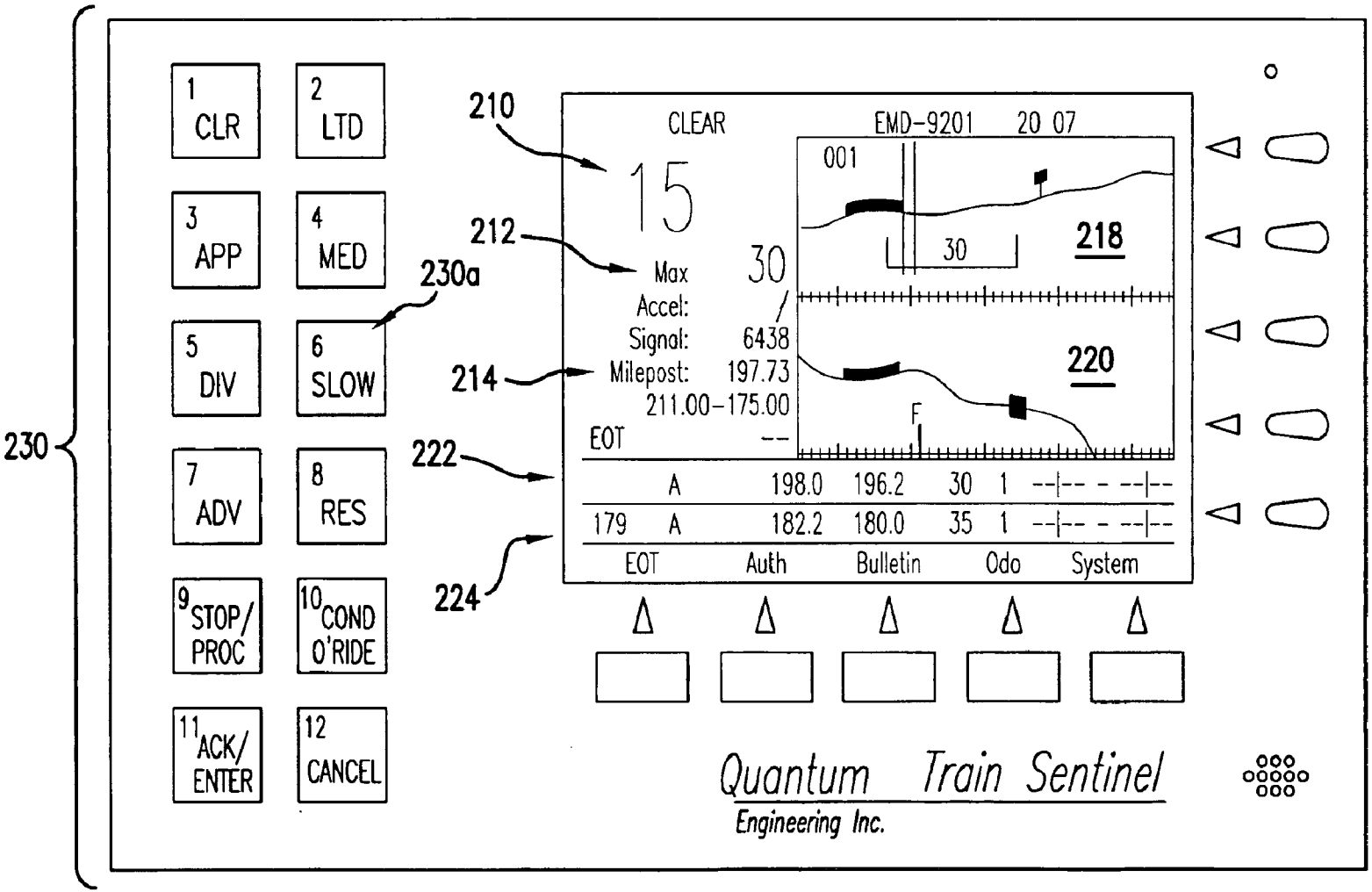
FIG. 2 is a perspective view of a display in the train control system of FIG. 1.

A display 180 connected to the control module 110 is used to present various information to the conductor or engineer. An exemplary display 200 is illustrated in FIG. 2. The display 200 shows the current train speed in field 210 and the maximum allowable speed (if a maximum is in effect) in field 212. The display 180 also shows the train's exact position in field 214 and the limits of the train's authority at filed 216. Also included in the display 180 is a first graph 218 indicating the grade of the tracks in the immediate area of the train and a second graph 220 indicating the direction of the track relative to the locomotive cab. The display 180 also lists, in fields 222 and 224, current and upcoming speed restrictions over limited areas of the track (in the example of FIG. 2, the speed restrictions are "Form A" speed restrictions, which will be discussed in further detail below).

The display also includes a number of acknowledgment buttons 230 as recited in U.S. Pat. No. 6,112,142. As the train approaches a wayside signal, the state of the signal is transmitted via radio to the system. When the operator sees the wayside signal, the operator must acknowledge the wayside signal by pressing a corresponding acknowledgment button. Thus, for example, if a wayside signal indicates 'slow,' the conductor or engineer must acknowledge the signal by pressing the slow button 230*a*. In this fashion, a record of the conductor's or engineer's alertness can be kept. If the conductor or engineer fails to acknowledge the wayside signal, a warning is shown on the display 180 and, if the conductor or engineer does not take corrective action, the system 100 automatically takes the required corrective action to ensure compliance with the wayside signal. Such corrective action can include a full braking penalty (wherein the brakes are applied such that the train stops) or a graduated braking penalty. In a graduated braking penalty, the brake pressure is increased until the train is in compliance with the signal, but may not involve actually stopping the train.

Because information from wayside signal is transmitted into the cab, wayside signaling lights are not necessary. Maintaining these lights on wayside signals is expensive, both because the bulbs are expensive and because the bulbs must be replaces periodically before they blow out. With wayside devices that transmit information to a cab, maintenance need only be performed when the device stops working and the time between failures in much longer; thus, the time between required maintenance trips to such wayside devices is much longer than is the case with lit wayside signal devices.

An event recorder 190 is also connected to the control module 110. The event recorder 190 serves a purpose similar to that served by a "black box" cockpit recorder in an airplane. The event recorder 190 records operating data, including communications to and from the train control system 100 and records operator actions such as acknowledgments of wayside signals as discussed above for investigation and/or training purposes.

The train system 100 is capable of two modes of operation. In the semiautomatic mode, movement of the train is under the control of the conductor or engineer provided that the conductor or engineer operates the train in an acceptable manner. In the automatic mode, the system 100 controls the movements of the train. In this mode, the conductor or engineer intervenes only when necessary to deal with unforseen situations, such as the presence of an unauthorized person or thing on the tracks.

In some embodiments of the invention, movement of the train is governed by warrants and authorities. Track on the main line (whether or not passing through a train yard) is typically under control of a dispatcher. Track warrants, sometimes referred to as track authorities, are issued by the dispatcher to control the movement of the train on the main line track. A track warrant is essentially a permission for a train to occupy and move on a section of main line track. The track warranty has start and end points, which are sometimes referred to as limits of authority. The start and end point together define a "block" of main line track. The track warrant may permit a train to move in one or both directions along the track, and may or may not be time- and speed-limited.

In contrast to main line track, movement of trains in a train yard is typically under the control of a yardmaster. The yardmaster is responsible for the movement of trains in a train yard, including movement of trains within the train yard (e.g., movement of a train from a resting place to a fuel depot or a repair facility) or from the yard to the main line track. The term "circulation authority" has sometimes been used, and will be used herein, to refer to an authority that permits a train or locomotive to move within an area of track (such as a train yard) not controlled by a dispatcher, or from an area of track not controlled by a dispatcher to an area of track that is controlled by a dispatcher. The circulation authority may be a simple permission for the train to move, or may provide start and end locations (e.g., the end location may correspond to the start location of the track warrant and the start location may correspond to the current location of the train/locomotive).

Circulation authorities and track warrants are sent to the control module 110. The authorities may be sent using wireless communications or by other means. Wayside transmitters may be installed along the track for the purpose of facilitating communications between the dispatcher and the train. The entities issuing the circulation authorities and track warrants may be a human being or a computer. The entity issuing a track warrant may be separate from or the same as the entity issuing a circulation authority.

As discussed above, vandalism concerning the unauthorized movement of trains is a serious problem. The present invention mitigates this problem by ensuring that the train has permission to move on the segment of track on which it is located before it can be moved at all. By way of comparison, while some of the descriptions of PTS systems the inventors hereof have seen in trade publications apparently indicate that a train will not be allowed to move until it has received a track warrant from a dispatcher (i.e., a track warrant or track authority), it appears that such systems will not prevent a vandal (or negligent engineer/conductor) from moving a train in a train yard after the train has received the track warrant but before the train has received a circulation authority to move the train to the section of main line track for which the dispatcher has issued the track warrant. Such unauthorized movement of the train can obviously cause much damage. In contrast, some embodiments of the system 100 will not allow a train that has received a track warrant to move until it has received a circulation authority to move to the section of main line track corresponding to the track warrant. Alternatively, some embodiments will accept an authority that includes both a block of main line track and an area of non-main line track. (In such systems, either a single entity controls both main line track and non-main line track, or the dispatcher and yardmaster communicate with each other so that such an authority may be issued).

Once an authority has been received by the system 100, the system 100 allows the conductor or engineer to move the train within the limits of that authority. As discussed above, a track warrant (or track authority) permits the operator to move the train along a block of main line track. The block is typically defined by specified mileposts or other boundaries. In addition to geographic limitations, authorities may also be limited by direction (i.e., a train may be authorized to move only north in a given block, or may be given authority to move back and forth along the track in the block) and/or speed.

All authorities are maintained in memory by the control module 110. When authorities are received from the dispatcher or yard master, all existing authorities are transmitted back to the dispatcher/yard master for verification. If the repeated authorities are correct, the dispatcher/yard master transmits an acknowledgment. Only after the acknowledgment is received is the train allowed to move. After this initial exchange, the dispatcher/yard master periodically transmits the current authority (or a number or other code associated with the current authority) to the control module 110. This serves as a "heartbeat" signal to the control module 110. When the current authority is received by the control module 110, it is checked against the authority that the control module believes is current. If the two authorities don't match, or if a current authority message has not been received for some threshold period of time, the control module 110 immediately stops the train and notifies the dispatcher of this event.

In addition to authorities, the control module 110 keeps track of other restrictions on movement of the train, such as wayside signals (which may or may not be under the control of the central dispatcher/authority), and permanent, temporary, and train-based speed restrictions. Temporary speed restrictions are sometimes referred to as Form A, Form B or Form C restrictions. Form A restrictions are typically issued as a result of temporary track conditions; e.g., if a section of track is somewhat damaged but still passable, a temporary speed restriction is issued. Form B speed restrictions are typically issued when maintenance personnel or some other personnel are on the track. Form C restrictions, which are mostly used in the northeastern U.S., are similar to Form A restrictions in that they involve track conditions. Train-based restrictions are based upon the type of train and/or locomotive.

If the train is in danger violating any authority, speed limit, wayside signal, or other restriction, the system 100 first takes corrective action in the form of warning the conductor or engineer via the display 180. If the conductor or engineer fails to take the requisite corrective action, the system 100 automatically implements further corrective action, such as applying a brake penalty. For example, the control module will monitor the train's position and determine its distance and time from the boundary of its authority being approached. The control module will also calculate the time and/or distance required to stop the train using the equations of physics, basic train handling principles and train control rules. This time/distance will depend upon factors such as the speed of the train, the weight and length of the train, the grade and amount of curvature of the upcoming track (which are determined using position information from the GPS receiver 130 as an index into the map database 140), braking power, braking ratios, type of brake equipment, aerodynamic drag of the train, etc. In more sophisticated embodiments, the location and weight of each car will be taken into account rather than simply a total weight of the train as differences in weight between cars becomes important when the different cars are on sections of track with different grades. A safety factor will be added in and, as a general rule, the safety factor can be smaller as additional information is taken into account because the equations should become more accurate.

The braking penalty may be full or graduated. A full braking penalty involves applying sufficient brake pressure to stop the train. Such a braking penalty may be imposed, for example, when the system is in semi-automatic mode and the engineer/conductor fails to acknowledge a stop signal. Completely stopping the train makes sense in this situation as the failure to acknowledge a stop signal may indicate that the conductor/engineer has become incapacitated. In this situation, the train may remain stopped until a central dispatcher authorizes the train to move again, thereby allowing the central dispatcher to ascertain the reason for the missed stop signal and to ensure that it is again safe to allow the train to move.

A graduated braking penalty involves applying brake pressure until the train is in compliance with the signal, restriction or other condition. For example, when a train violates a temporary speed restriction, the brakes may be applied until the train has slowed to the maximum allowable speed. As another example, the brake pressure may be adjusted to reduce the speed of the train to ensure that the speed is such that the train is further away from a stop signal than the maximum distance required to stop the train. With such a graduated penalty, the brakes will be applied until the train slows to a stop just before the stop signal.

Communications between the various components of the system 100 can be conducted using methods currently developed or developed in the future. In some embodiments employing a modular construction wherein logical portions of the system are in separate physical units, one form of communication that may be used is power line carrier communication. Power line carrier communication involves transmitting information signals over conductors carrying electrical power (power line carrier communication is well known to those of skill in the art and thus will not be discussed in further detail herein). Thus, for example, communications between the HOT transceiver 160 and the EOT transceiver 172 may be performed using power line carrier methods.

In some embodiments, power line communications or other communication methods may be employed to provide for redundancy in the case of a system failure. For example, in some embodiments, if a portion of the system such as the GPS receiver 130 fails in the lead locomotive of a multi-locomotive consist, the control module 110 may communicate via power line communication (or other) methods with the next-closest GPS receiver 130 in one of the other locomotives near the front of the train. In such embodiments, a complete system 100 may be formed from components in a number of different locomotives/cars on a single consist.

In some embodiments, a collision avoidance feature is also included. In such embodiments, each train transmits its current location and speed, and receives current locations and speeds from other trains. This allows the control module 110 to automatically detect that a collision will occur and take appropriate corrective action, which can include stopping the train, warning the other train to stop, and warning the operator and the dispatcher.

In other embodiments, the central dispatcher sends the location, speed and direction of each of the other trains in a nearby area to the control module 110. The control module 110 displays this information in graphical form on the display 180 in a PPI (plan position indicator) format similar to the graphical representation of aircraft on an air traffic controller screen (e.g., with a graphical vector wherein the orientation of the vector indicates the direction in which the other trains are traveling and the length of the vector indicates the speed). This allows conductors/engineers to quickly detect potential collisions and take action to avoid such collisions.

In the embodiments discussed above, the control module 110 is located on the train. It should also be noted that some or all of the functions performed by the control module 110 could be performed by a remotely located processing unit such as processing unit located at a central dispatcher. In such embodiments, information from devices on the train (e.g., the brake interface 150) is communicated to the remotely located processing unit via the communications module 120.

Obviously, numerous modifications and variations of the present invention are possible in light of the above teachings. It is therefore to be understood that within the scope of the appended claims, the invention may be practiced otherwise than as specifically described herein.

What is claimed is:

1. A method for authorizing movement of a plurality of trains, the method comprising the steps of:

setting an end point and a start point of a block of track dynamically;

authorizing a first train to occupy the block of track receiving an indication from the first train that a global positioning sensor located at a rear of the first train has passed the end point; and authorizing a second train to occupy the block of track.

2. A train comprising:

an end car;

a positioning system located on the end car;

a control unit in communication with the positioning system, the control unit being configured to accept a dynamically determined end point from a dispatcher of a block which the train has been authorized to occupy and to transmit a message to the dispatcher indicating that the positioning system has passed the end point.

3. The train of claim 2, further comprising:

a storage device connected to the control unit, the storage device including a database, the database including a location of the end point.

4. The train of claim 3, wherein the storage device is a non-volatile memory.

* * * * *